US005464660A

United States Patent [19]

Becker et al.

[11] Patent Number: 5,464,660

[45] Date of Patent: Nov. 7, 1995

[54] USE OF SPECIAL COMPOUNDS AS SMOOTHING AGENTS IN COMBING OILS

[75] Inventors: Wolfgang Becker, Moenchengladbach; Raymond Mathis, Duesseldorf; Syliva Stapper-Druyen, Moenchengladbach; Karin Robrahn, Mettmann; Rainer Hoffmann, Bremen; Yasar C. Kiray, Bremen, all of Germany

[73] Assignee: Henkel Kommanditgesellschaft auf Aktien, Duesseldorf, Germany

[21] Appl. No.: 140,116

[22] PCT Filed: Apr. 23, 1992

[86] PCT No.: PCT/EP92/00903

§ 371 Date: Apr. 8, 1994

§ 102(e) Date: Apr. 8, 1994

[87] PCT Pub. No.: WO92/19805

PCT Pub. Date: Nov. 12, 1992

[30] Foreign Application Priority Data

May 2, 1991 [DE] Germany ..... 41 14 240.3

[51] Int. Cl.[6] ..... B05D 3/02

[52] U.S. Cl. ..... 427/389; 8/128.1; 19/115 R; 428/291

[58] Field of Search ..... 8/115.51, 128.1; 19/115 R; 427/389; 428/291

[56] References Cited

U.S. PATENT DOCUMENTS

| | | | |
|---|---|---|---|
| 2,212,369 | 8/1940 | Jaeger | 252/57 |
| 3,628,908 | 12/1971 | Goldberg et al. | 8/127.6 |
| 3,628,909 | 12/1991 | Goldberg et al. | 8/127.6 |
| 4,122,018 | 10/1978 | Waltenberger | 252/8.6 |

FOREIGN PATENT DOCUMENTS

| | | |
|---|---|---|
| 0280206 | 8/1988 | European Pat. Off. . |
| 2621881 | 12/1977 | Germany . |
| 3706362 | 9/1988 | Germany . |
| 0208479 | 12/1923 | United Kingdom . |
| 0547667 | 9/1942 | United Kingdom . |
| 1290688 | 9/1972 | United Kingdom . |

OTHER PUBLICATIONS

Handbuch für Textlingenieure und Textilpra ktier, herausegegen von Prof. E. Wagner, 2. Auflage, 1974, Oskar–Spohr–Verlag, Frankfurt am Main, S 47 ff.

Textil praxis international, 45, Jg. Konradin Verlag, Leinfelden, Oct. 1990, Aufsatz von W. Becker, S. 1035–1038.

Römpps Chemie–Lexikon, 8. Aufl. Band 5, S. 3727 f, Stuttgart 1987.

Ullmann's Enzyklopädie der technischen Chemie, 4. Auflage, Band 8, 1974, S. 146–156, Verlg Chemie, Weinheim.

*Primary Examiner*—Michael Lusignan

*Attorney, Agent, or Firm*—Ernest G. Szoke; Norvell E. Wisdom, Jr.; Real J. Grandmaison

[57] ABSTRACT

Special compounds, having solidification points above 25° C., selected from the group of dialkylethers and/or carboxylic acid esters are used as smooth agents for the production of wool combed slivers.

20 Claims, No Drawings

USE OF SPECIAL COMPOUNDS AS SMOOTHING AGENTS IN COMBING OILS

FIELD OF THE INVENTION

This invention relates to the use of compounds, having solidification points above 25° C., selected from the group of dialkyl esters containing two identical or different hydrocarbon radicals, carboxylic acid esters of monocarboxylic and/or dicarboxylic acids and aliphatic monohydric alcohols and esters of dihydric, trihydric and/or tetrahydric alcohols and aliphatic monocarboxylic acids as smoothing agents in combing oils for the production of combed slivers of wool and to a process for smoothing wool in the production of combed slivers using compounds selected from the above-mentioned group with solidification points above 25° C.

STATEMENT OF RELATED ART

Before spinning, wool which is to be processed into combed slivers has to be intensively washed to remove inorganic fiber soils, such as sand, dust and suint salts, and organic fiber soils, such as straw, food remains, wool grease and perspiration. Removal of the fiber soils and particularly the removal of wool wax and wool grease alters the static and dynamic frictional characteristics of the wool to a considerable extent, so that subsequent processing of the wool becomes extremely problematical, particularly where intensive fiber/fiber and fiber/metal friction occurs. The wool fibers are heavily stressed above all during the carding process, in which a sliver (combed sliver) is produced by parallelizing and fine opening. This stressing often leads to electrostatic charging and to a reduction in the mean staple length of the wool and also to an increase in the combing waste. To counteract electrostatic charging, reductions in the mean staple length and combing waste, the wool has to be treated with combing oils after washing and before carding. Smoothing agents liquid at 20° to 25 ° C. (room temperature), such as olive oil, peanut oil, olein, fats, fatty acid esters and mineral oils of various kinds, are normally used in combination with emulsifiers as the combing oils (cf. *Handbuch für Textilingenieure und Textilpraktiker* [English translation of title: Handbook for Textile Engineering and Textile Practice], edited by Prof. E. Wagner, 2nd Edition (Oskar-Spohr-Verlag, Frankfurt am Main, 1974), pages 47 et seq. and *Textil praxis international* [English translation of title: International Textile Practice], Vol. 45, (Konradin Verlag, Leinfelden, October 1990), Article by W. Becker, pages 1035–1038. In the context of the invention, therefore, combing oils are understood to be a mixture of smoothing agents and emulsifiers.

Although these liquid combing oils are capable of favorably influencing the reduction in mean staple length, combing waste and the electrostatic effect, there is still a need for combing oils which have improved effects. Thus, the carding rate can be increased by reducing electrostatic charging, while product quality can be increased by counteracting the reduction in mean staple length, which is of considerable economic value to manufacturers of combed slivers.

DE-A-37 06 362 describes dialkyl ether compounds containing identical or different saturated and/or unsaturated hydrocarbon radicals containing 6 to 24 carbon atoms. These dialkyl ether compounds may be applied as smoothing agents to textile fibers of various kinds, inter alia in the form of dispersions, in order to reduce fiber/metal friction. Although wool is among the textile fiber materials mentioned in the document in question, there is no reference to the fact that the reduction of mean staple length, combing waste and electrostatic charging are improved by treatment with dialkyl ethers having solidification points above 25° C.

DE-A-26 21 881 describes a mixture of fatty acid esters of $C_{14-18}$ fatty acids and monohydric $C_{1-8}$ alcohols, paraffins melting at 40° to 60° C. and fatty acid amidopolyamines as a smoothing agent. Smoothing agents of this type provide textile fiber materials, including wool, that are treated with the smoothing agents with the smoothness required for subsequent processing.

GB-C-1,290,688 describes textile treatment preparations containing esters of $C_{16-30}$ monocarboxylic acids and long-chain monohydric $C_{12-30}$ alcohols. Natural and above all synthetic fibers thus treated have the advantage that they are soil-repellent.

DESCRIPTION OF THE INVENTION

Object of the Invention

The problem addressed by the present invention was to provide compounds for use in combing oils which would provide wool with a high degree of smoothness and would minimize the reduction of mean staple length, combing waste and electrostatic charging. In addition, the compounds would be readily removable by washing out in the same way as conventional combing oils and would not contain any resinous, tacky or even slightly wool-damaging constituents.

SUMMARY OF THE INVENTION

It has now surprisingly been found that the problem addressed by the invention can be solved by the use of compounds, having solidification points above 25° C., selected from the group of dialkyl ethers, carboxylic acid esters of monocarboxylic and/or dicarboxylic acids with monohydric alcohols and esters of dihydric, trihydric and/or tetrahydric alcohols with aliphatic monocarboxylic acids.

The present invention relates to the use of one or more compounds having solidification points above 25° C. selected from the group consisting of:

A) dialkyl ethers containing 2 identical or different aliphatic hydrocarbon radicals each containing 6 to 22 carbon atoms, B) carboxylic acid esters of aliphatic monocarboxylic and/or dicarboxylic acids containing 2 to 22 carbon atoms and aliphatic monohydric alcohols containing 1 to 22 carbon atoms and C) esters of dihydric, trihydric and/or tetrahydric aliphatic alcohols containing 2 to 22 carbon atoms and aliphatic monocarboxylic acids containing 2 to 22 carbon atoms as smoothing agents in combing oils for the production of combed slivers of wool.

In the context of the invention, the expression solidification point stands for the so-called riser melting point as defined in *Römpps Chemie-Lexikon* [English translation of title: Römpp's Chemical Dictionary], 8th Edition, Vol. 5, pages 3727 et seq., Stuttgart (1987). According to this definition, the solidification point is the temperature at which the sample accommodated in a capillary, which is open at both ends and suspended in a water bath, begins to rise in the glass tube.

The smoothing agents used in accordance with the invention, which are selected from the group of compounds A), B) and C), should all have a solidification point above 25° C. Compounds which have a solidification point of 30° to 100°

C. and, more particularly, up to 80° C. are preferred. The physical state—as defined by the solidification point—of the compounds used in accordance with the invention is crucial to the invention, because only compounds which are solid at room temperature should be used for the purposes of the invention. Thus, applicants' own tests have shown that compounds of comparable chemical structure show significant differences in the friction values, wool lengths and combing waste according to the solidification points of the compounds.

DESCRIPTION OF PREFERRED EMBODIMENTS

The dialkyl ethers according to the invention are commercially available products and are generally produced by catalytic dehydration of alcohols or by reaction of alkyl halides with alcoholates (Williamson synthesis), for example as described in *Ullmann's Enzyklopädie der technischen Chemie* [English translation of title: Ullmann's Encyclopedia of Chemical Technology], 4th Edition, Vol. 8 (Verlag Chemie, Weinheim, 1974), pages 146–156. The dialkyl ethers used in accordance with the invention may be symmetrical and/or asymmetrical dialkyl ethers containing two identical or different aliphatic hydrocarbon radicals, each containing 6 to 22 carbon atoms. The two aliphatic hydrocarbon radicals attached to one another by the ether oxygen may be saturated and/or unsaturated, branched and/or unbranched. Dialkyl ethers containing two identical or different aliphatic, saturated hydrocarbon radicals each containing 6 to 22 carbon atoms and preferably 8 to 22 carbon atoms are preferred. From the point of view of biodegradability, it is best to use dialkyl ethers containing identical or different aliphatic, saturated, unbranched hydrocarbon radicals each containing an even number of carbon atoms. Particularly suitable dialkyl ethers are ditallow ethers, distearyl ethers, dilauryl ethers and/or technical mixtures, such as dicoconut oil fatty alcohol ethers.

The compounds used in accordance with the invention, with solidification points above 25° C. may also be selected from the group consisting of carboxylic acid esters of aliphatic monocarboxylic and/or dicarboxylic acids containing 2 to 22 carbon atoms and aliphatic monohydric alcohols containing 1 to 22 carbon atoms. Carboxylic acid esters are also commercially available products and are obtained by esterification of monocarboxylic and/or dicarboxylic acids with the monohydric alcohols in suitable quantity ratios or by transesterification of carboxylic acid esters with other monohydric alcohols. The monocarboxylic acid esters used in accordance with the invention may be derived from aliphatic, saturated and/or unsaturated, branched and/or unbranched monocarboxylic acids containing 2 to 22 carbon atoms. Suitable monocarboxylic acids are butyric acid, valeric acid, caproic acid, caprylic acid, capric acid, lauric acid, tridecanoic acid, myristic acid, pentadecanoic acid, palmitic acid, heptadecanoic acid, stearic acid, behenic acid, oleic acid, ricinoleic acid, linoleic acid and/or linolenic acid. Suitable aliphatic dicarboxylic acids are carboxyl-terminated saturated and/or unsaturated dicarboxylic acids, such as azelaic acid, oxalic acid, succinic acid, maleic acid and/or adipic acid. Suitable aliphatic monohydric alcohols are saturated and/or unsaturated and also branched and/or unbranched alcohols containing 1 to 22 carbon atoms, such as methanol, ethanol, butanol, propanol, caproic alcohol, capryl alcohol, pelargonic alcohol, capric alcohol, lauryl alcohol, n- and iso-pentadecanol, palmitoleyl alcohol, stearyl alcohol, behenyl alcohol, oleyl alcohol, ricinoleyl alcohol and/or linolenyl alcohol. Of these, the aliphatic, saturated, branched and/or unbranded monohydric alcohols are particularly suitable. Stearyl stearate, methyl stearate, methyl behenate, lauryl stearate, decyl stearate, octyl behenate, butyl behenates, dimethyl oxalate, dimethyl sebacate and/or dioctyl adipate are very good carboxylic acid esters.

Finally, the compounds according to the invention may be selected from the group of esters of dihydric, trihydric and/or tetrahydric aliphatic alcohols containing 2 to 22 carbon atoms and aliphatic monocarboxylic acids containing 2 to 22 carbon atoms. Esters of saturated aliphatic dihydric, trihydric and/or tetrahydric alcohols, such as esters of ethylene glycol, diethylene glycol, neopentyl glycol, butanediols, hexanediols, butane-1,2,4-triol, trimethylol propane, trimethylol ethane, pentaerythritol and/or glycerol, are preferred. Suitable aliphatic monocarboxylic acids containing 2 to 22 carbon atoms were mentioned in the discussion of the carboxylic acid esters of aliphatic monohydric alcohols. The esters of glycerol, triglycerides, may be of natural and/or synthetic origin. Triglycerides of natural origin, such as coconut oil, palm kernel oil, bay oil, cocoa butter and beef tallow, and hydrogenated vegetable oils, such as hydrogenated soybean oil, hydrogenated castor oil and hydrogenated rapeseed oil, are preferred. The naturally occurring triglycerides may of course be modified by transesterification with one of the above-mentioned aliphatic monocarboxylic acids containing 2 to 22 carbon atoms. The equally suitable esters of the other dihydric, trihydric and/or tetrahydric aliphatic alcohols containing 2 to 22 carbon atoms are generally produced by direct esterification of the aliphatic monocarboxylic acid with the alocohol. Glycerol tristearate, trimethylol propane tristearate, glycerol monolauryl distearate are most particularly suitable compounds of group C).

According to the invention, one or more compounds selected from the described groups may be used. The ratios in which the compounds selected from groups A), B) and C) are mixed are variable within wide limits and are determined solely by the miscibility or homogenizability of the compounds with one another.

One or more compounds with the above-mentioned solidification points selected from the group consisting of:

B) carboxylic acid esters of aliphatic mono- and/or dicarboxylic acids containing 2 to 22 carbon atoms and aliphatic monohydric alcohols containing 1 to 22 carbon atoms and C) esters of dihydric, trihydric and/or tetrahydric aliphatic alcohols containing 2 to 22 carbon atoms and aliphatic monocarboxylic acids containing 2 to 22 carbon atoms show particularly good smoothing properties.

Of these compounds, carboxylic acid esters of aliphatic, saturated monocarboxylic and/or dicarboxylic acids containing 2 to 22 carbon atoms and aliphatic, saturated monohydric alcohols containing 1 to 22 carbon atoms and esters of saturated dihydric, trihydric and/or tetrahydric aliphatic alcohols containing 2 to 22 carbon atoms and aliphatic saturated monocarboxylic acids containing 2 to 22 carbon atoms are preferred. Of the esters of saturated trihydric and/or tetrahydric alcohols, the esters of glycerol, trimethylol propane and/or pentaerythritol are most particularly preferred.

The compounds according to the invention are used as smoothing agents in combing oils in quantities of 50 to 95% by weight in combination with emulsifiers and typical auxiliaries. The compounds according to the invention are preferably used in quantities of 50 to 90% by weight mixed with emulsifiers in quantities of 5 to 50% by weight, the quantities having to add up to 100% by weight. The mixed emulsifiers may show nonionic, cationic, anionic and/or amphoteric character in water. Suitable nonionic emulsifiers are alkoxylated, preferably ethoxylated and/or propoxylated, fats, oils, fatty alcohols containing 8 to 24 carbon atoms, fatty amines containing 8 to 24 carbon atoms in the fatty component and/or $C_{8-18}$ alkyl phenols. Examples include castor oil containing 25 moles of ethylene oxide (EO), tallow alcohol containing 5 moles of EO, tallow alcohol containing 20 moles of EO, tallow alcohol containing 9 moles of propylene oxide (PO) and 5.5 tool EO, (12/14 laurol alcohol containing 5 PO and 4 EO), $C_{12-18}$ coconut oil fatty alcohol containing 10 moles of EO, nonylphenol containing 10 moles of EO and/or fatty amines, such as coconut oil amine, tallow amine, oleyl amine containing 2 to 20 moles of EO. Suitable cationic emulsifiers are alkoxylated, preferably ethoxylated and/or propoxylated, alkyl amines containing 10 to 22 carbon atoms in the alkyl radical in the form of their ammonium salts, for example stearyl amine containing 10 moles of EO. Suitable anionic emulsifiers are, for example, alkali metal and/or ammonium salts of $C_{6-24}$ fatty acids, $C_{8-22}$ alkyl and/or $C_{8-22}$ alkylether sulfates, $C_{8-22}$ alkyl and/or $C_{8-22}$ alkylbenzene sulfonates, $C_{8-22}$ alkyl and/or $C_{8-22}$ alkylbenzene sulfosuccinates and/or $C_{8-22}$ alkyl and/or $C_{8-22}$ alkylether phosphates. Examples of amphoteric emulsifiers are $C_{8-22}$ alkyl dimethyl betaines, N-$C_{8-22}$-alkylamidobetaines and/or amphoteric surfactants derived from amino acids.

To produce the combing oils, the compounds used in accordance with the invention are melted and stirred at 40° to 100° C. together with one or more un-troublesome emulsifiers.

In addition to surface slip properties, combing oils are often required to show other properties, such as low foaming, softening and little, if any, yellowing of the wool flock. To meet these requirements, typical auxiliaries may optionally be added in admixture with the compounds and emulsifiers used in accordance with the invention in quantities of 0 to 20% by weight, based on 100% by weight combing oil. Examples of typical auxiliaries are antioxidants, foam inhibitors, stabilizers, antistatic agents, preservatives, pH regulators and/or fragrances. Auxiliaries such as these are known from the prior art. An exemplary list of suitable typical auxiliaries can be found in DE-A-37 06 362.

The combing oils in which the compounds according to the invention are used may be applied to the wool either in pure form or in the form of dispersions. For application of the pure combing oils, the compounds according to the invention are melted in admixture with emulsifiers and optionally typical auxiliaries and applied to the wool by suitable machines, such as metering pumps or spray systems. In addition, the combing oils may be applied in the form of aqueous or organic dispersions. Organic solvents suitable for organic dispersions are, for example, aliphatic and/or aromatic hydrocarbons, such as gasoline, cyclohexane, toluene, xylene, or halogenated, preferably chlorinated, hydrocarbons, such as methylene chloride or perchloroethylene. However, aqueous dispersions of combing oils are preferred for ecological and safety reasons. To prepare the aqueous dispersions of the combing oils, the combing oils are melted at 40° to 100° C. before the water is added, optionally under pressure. However, the molten combing oils may also be added to water which has been heated to 50° to 100° C. Fine-particle aqueous dispersions having solids contents of 5 to 40% by weight are obtained and are generally adjusted to a pH value of 7 to 10 by pH regulators. The aqueous dispersions may also be applied in known manner, for example by spraying or by forced application in a bath, preferably in the final washing bath in the washing of raw wool.

The compounds used in accordance with the invention, in admixture with emulsifiers and optionally typical auxiliaries, are applied to the wool flocks before carding. In general, the combing oils are applied to the wool or blends thereof in quantities of 0.2 to 1.5% by weight and preferably in quantities of up to 0.6% by weight, based on the total active substance content.

By using the compounds according to the invention, with solidification points above 25° C., selected from groups A), B) and C) and preferably from groups B) and C) in combing oils, correspondingly treated wool can be protected against severe mechanical stressing, for example during carding. Distinctly reduced electrostatic charging is observed, reductions in mean staple fiber length are minimized and the amount of combing waste accumulating is reduced by comparison with smoothing compounds which are liquid at 25° C.

The present invention also relates to a process for smoothing wool in the production of combed slivers using combing oils containing smoothing agents, characterized in that one or more compounds, having solidification points above 25° C., selected from the group consisting of:

A) dialkyl ethers containing 2 identical or different aliphatic hydrocarbon radicals each containing 6 to 22 carbon atoms, B) carboxylic acid esters of aliphatic monocarboxylic and/or dicarboxylic acids containing 2 to 22 carbon atoms and aliphatic monohydric alcohols containing 1 to 22 carbon atoms and C) esters of dihydric, trihydric and/or tetrahydric aliphatic alcohols containing 2 to 22 carbon atoms and aliphatic monocarboxylic acids containing 2 to 22 carbon atoms are used as the smoothing agents.

Particulars of the compounds mentioned and their application can be found in the foregoing.

EXAMPLES

Production of the combing oils

Example 1

78.0 g of stearic acid methyl ester, 8.0 g of an alcohol mixture of 0 to 2% by weight of $C_{12}$, 27 to 35% by weight of $C_{16}$, 1 to 7% by weight of $C_{14}$, 55 to 75% by weight of $C_{18}$, 0 to 2% by weight of $C_{20}$, ethoxylated with 5 moles of ethylene oxide (EO); 4.5 g of a $C_{12}$ (70% by weight) and $C_{14}$ (30% by weight) fatty alcohol mixture ethoxylated with 6 moles of EO, 5.5 g of alkylbenzene sulfonic acid (purity 97%) and 4.0 g of diethanolamine were mixed while stirring at 60° C. to 70° C. A whitish product solid at room temperature was obtained.

Example 2

40.0 g of n-octyl behenate, 20 g of hydrogenated beef tallow (% by weight: 0.5 $C_{12}$, 3–6 $C_{14}$, 28–42 $C_{16}$, 41–82 $C_{18}$, 0.5 $C_{20}$, 0.5 $C_{22}$), 10.0 g of the K salt of the phosphoric acid ester of stearyl/cetyl alcohol containing 10.5 moles of EO, 9.0 g of hydrogenated castor oil containing 25 moles EO, 9 g of tallow alcohol containing 9 moles of propylene oxide (PO) and 5.5 moles of EO and 12 g of an oleyl/cetyl alcohol (% by weight: 0–3 $C_{14}$, 8–30 $C_{16}$, 60–83 $C_{18}$) containing 10 moles of EO were mixed together as in Example I. A solid product having a softening point of 40° C. was obtained.

Example 3

76.5 g of ethylene glycol dilaurate, 8.0 g of a $C_{12-18}$ alcohols mixture (% by weight: 0–2 $C_{12}$, 1–7 $C_{14}$, 27–35 $C_{16}$, 55–75 $C_{18}$, 0–2 $C_{20}$) ethoxylated with 5 moles, 4.5 g of $C_{12/14}$ alcohol (% by weight: 70 $C_{12}$, 30 $C_{14}$) containing 6 moles of EO, 7.0 g of alkylbenzene sulfonic acid and 4.0 g of diethanolamine were mixed together as in Example 1. A solid product having a softening point of 53° to 55 ° C. was obtained.

Comparison Example 1

Commercially available combing oil Selbana® 4554 (a product of Henkel KGaA) containing 60 to 80% by weight of a fatty acid methyl ester liquid at 25° C.

Comparison Example 2

A combing oil was prepared in the same way as in Example 3, except that the ethylene glycol dilaurate was replaced by the ester of ethylene glycol with tallow fatty acid (% by weight: approximately 3 $C_{14}$, 27–31 $C_{16}$, 58–68 $C_{18}$, approximately 1 $C_{20}$), which is liquid at room temperature.

Application Example 1

Washed and dried wool in flock form (Australian grease wool with an average diameter of 21.9 μm and an average length of 64 mm according to the raw wool certificate, i.e. estimated values) was sprayed with aqueous dispersions of the combing oils of Examples 1 to 3 and Comparison Examples 1 and 2 at approximately 25° C./55% relative air humidity. The application of combing oil amounted to 0.4% by weight and of water to 0.6% by weight, based on the weight of the wool. The average fiber length H (in mm) was determined after carding but before combing using a Peyer Almeter al 100. The combing waste (in %) and the combed slivers (in %, based on washed and dried flocks) were determined by control weighings. The results obtained are set out in Table 1.

TABLE 1

| Combing oil according to | H (in mm) before combing | Combing waste (%) | Combed slivers (%) |
|---|---|---|---|
| Example 1 | 65.4 | 4.48 | 90.62 |
| Example 2 | 66.0 | 4.97 | 90.32 |
| Comparison Example 1 | 61.8 | 5.04 | 89.98 |
| Example 3 | 61.2 | 4.57 | 90.69 |
| Comparison Example 2 | 58.5 | 5.38 | 88.69 |

It can be seen from Table 1 that the esters of monocarboxylic acids with alkanols (Examples 1, 2 and Comparison Example 1 ) are overall slightly better than the esters of diols with monocarboxylic acids (Example 3 and Comparison Example 2). However, among the esters of comparable chemical structure, it is quite clear that the combing oils according to the invention containing solid esters are superior to the liquid esters in all the aspects investigated. Thus, the length H after carding is greater, i.e., the combing oils according to the invention protect the wool more effectively against reductions in staple length (cf. Example 1 with Comparison Example 1 or Example 3 with Comparison Example 2). Accordingly, less combing waste and more combed slivers are obtained with the combing oils according to the invention.

Application Example 2

Washed and dried wool in flock form (22.0 to 22.5 μ and approximately 12 to 14% moisture content) were sprayed with Example 1 and Comparison Example 1 at approximately 25° C./55% relative humidity. The application of combing oil to the wool flocks amounted to 0.3% by weight and of water to 0.7% by weight, based on the weight of the wool. Electrostatic charging was measured at the card exit by the induction current method using an Eltex machine (arranged at a distance of 100 mm). It can be seen from Table 2 below that wool flocks treated with combing oils according to the invention show less electrostatic charging than wool flocks treated with combing oils according to Comparison Example 1.

TABLE 2

| Combing oil according to | Electrostatic charging (KV $m^{-1}$) |
|---|---|
| Example 1 | −20 |
| Comparison Example 1 | −50 |

The invention claimed is:

1. A process for producing combed slivers of wool from washed and carded wool bearing a combing oil applied after washing and before carding, wherein the improvement comprises the use of a combing oil comprising a smoothing effective amount of one or more compounds, having solidification points above 25° C., selected from the group consisting of:

A) dialkyl ethers containing 2 identical or different aliphatic hydrocarbon radicals each containing 6 to 22 carbon atoms;

B) carboxylic acid esters of aliphatic monocarboxylic and dicarboxylic acids containing 2 to 22 carbon atoms and aliphatic monohydric alcohols containing 1 to 22 carbon atoms; and C) esters of dihydric, trihydric and tetrahydric aliphatic alcohols containing 2 to 22 carbon atoms and aliphatic monocarboxylic acids containing 2 to 22 carbon atoms.

2. A process as claimed in claim 1, wherein the combing oil comprises compounds selected from groups A), B) and C) with solidification points of 30° to 80° C.

3. A process as claimed in claim 2, wherein the combing oil comprises one or more compounds selected from the group consisting of:

A) dialkyl ethers containing 2 identical or different saturated aliphatic hydrocarbon radicals each containing 6 to 22 carbon atoms;

B) carboxylic acid esters of aliphatic monocarboxylic and dicarboxylic acids containing 2 to 22 carbon atoms and saturated aliphatic monohydric alcohols containing 1 to 22 carbon atoms; and C) esters of dihydric, trihydric and tetrahydric aliphatic alcohols containing 2 to 22 carbon atoms and aliphatic monocarboxylic acids containing 2 to 22 carbon atoms.

4. A process as claimed in claim 3, wherein the combing oil comprises one or more compounds selected from the group consisting of:

B) carboxylic acid esters of aliphatic saturated monocarboxylic and dicarboxylic acids containing 2 to 22 carbon atoms and aliphatic, saturated monohydric alcohols containing 1 to 22 carbon atoms; and C) esters of saturated dihydric, trihydric and tetrahydric aliphatic alcohols containing 2 to 22 carbon atoms and aliphatic saturated monocarboxylic acids containing 2 to 22 carbon atoms.

5. A process as claimed in claim 4, wherein the combing oil comprises one or more compounds selected from the group consisting of:

B) carboxylic acid esters of aliphatic saturated monocarboxylic and dicarboxylic acids containing 2 to 22 carbon atoms and aliphatic, saturated monohydric alcohols containing 1 to 22 carbon atoms; and C) esters of ethylene glycol, diethylene glycol, butanediols, glycerol, trimethylol propane and pentaerythritol and aliphatic saturated monocarboxylic acids containing 2 to 22 carbon atoms.

6. A process as claimed in 5, wherein the combing oil comprises one or more compounds selected from groups A), B) and C) in quantities of 50 to 95% by weight in admixture with emulsifiers and optionally auxiliaries.

7. A process as claimed in 6, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

8. A process as claimed in claim 7, wherein the combing oil is applied to the wool flocks before carding in pure form or in the form of a dispersion.

9. A process as claimed in claim 1, wherein the combing oil is applied to the wool flocks before carding in pure form or in the form of a dispersion.

10. A process as claimed in claim 1, wherein the combing oil comprises compounds selected from groups A), B) and C) with solidification points of 30° to 100° C.

11. A process as claimed in claim 1, wherein the combing oil comprises one or more compounds selected from the group consisting of:

A) dialkyl ethers containing 2 identical or different saturated aliphatic hydrocarbon radicals each containing 6 to 22 carbon atoms;

B) carboxylic acid esters of aliphatic monocarboxylic and dicarboxylic acids containing 2 to 22 carbon atoms and saturated aliphatic monohydric alcohols containing 1 to 22 carbon atoms; and C) esters of dihydric, trihydric and tetrahydric aliphatic alcohols containing 2 to 22 carbon atoms and aliphatic monocarboxylic acids containing 2 to 22 carbon atoms.

12. A process as claimed in claim 1, wherein the combing oil comprises one or more compounds selected from the group consisting of:

B) carboxylic acid esters of aliphatic saturated monocarboxylic and dicarboxylic acids containing 2 to 22 carbon atoms and aliphatic, saturated monohydric alcohols containing 1 to 22 carbon atoms; and C) esters of saturated dihydric, trihydric and tetrahydric aliphatic alcohols containing 2 to 22 carbon atoms and aliphatic saturated monocarboxylic acids containing 2 to 22 carbon atoms.

13. A process as claimed in claim 1, wherein the combing oil comprises one or more compounds selected from the group consisting of:

B) carboxylic acid esters of aliphatic saturated monocarboxylic and dicarboxylic acids containing 2 to 22 carbon atoms and aliphatic, saturated monohydric alcohols containing 1 to 22 carbon atoms; and C) esters of ethylene glycol, diethylene glycol, butanediols, glycerol, trimethylol propane and pentaerythritol and aliphatic saturated monocarboxylic acids containing 2 to 22 carbon atoms.

14. A process as claimed in claim 1, wherein the combing oil comprises one or more compounds selected from groups A), B) and C) in quantities of 50 to 95% by weight in admixture with emulsifiers and optionally auxiliaries.

15. A process as claimed in claim 13, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

16. A process as claimed in claim 5, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

17. A process as claimed in claim 4, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

18. A process as claimed in claim 3, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

19. A process as claimed in claim 2, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

20. A process as claimed in claim 1, wherein the combing oil consists essentially of one or more compounds selected from groups A), B) and C) in quantities of 50 to 95% by weight; emulsifiers in quantities of 5 to 50% by weight; and optionally auxiliaries in quantities of 0 to 20% by weight.

* * * * *